US007389574B2

(12) United States Patent
Smith

(10) Patent No.: US 7,389,574 B2
(45) **Date of Patent: *Jun. 24, 2008**

(54) METHOD OF ENABLING THE STACKING OF ELECTROWON METAL UNITS

(76) Inventor: Richard A. Smith, 1218 6th Ave., Safford, AZ (US) 85546

( * ) Notice: Subject to any disclaimer, the term of this patent is extended or adjusted under 35 U.S.C. 154(b) by 135 days.

This patent is subject to a terminal disclaimer.

(21) Appl. No.: 10/818,621

(22) Filed: Apr. 5, 2004

(65) Prior Publication Data

US 2004/0187285 A1 Sep. 30, 2004

Related U.S. Application Data

(63) Continuation-in-part of application No. 09/875,528, filed on Jun. 5, 2001, now Pat. No. 6,751,836.

(51) Int. Cl.
*B23P 15/00* (2006.01)

(52) U.S. Cl. ..... 29/407.09; 414/788.1; 414/788.2

(58) Field of Classification Search ..... 29/521, 29/469, 825, 623.1, 407.09; 414/788.2, 788.1; 204/292, 280; 72/379.2, 379.6; 211/126.7, 211/126.12, 188, 194; 700/213; 205/574, 205/291; 248/300; 429/220
See application file for complete search history.

(56) References Cited

U.S. PATENT DOCUMENTS

| | | | | |
|---|---|---|---|---|
| 2,062,099 | A * | 11/1936 | MacChesney | 24/23 W |
| 2,704,974 | A * | 3/1955 | Steman | 99/422 |
| 4,525,925 | A * | 7/1985 | Jones | 29/598 |
| 4,555,942 | A * | 12/1985 | Ludvigsson | 73/433 |
| 4,737,217 | A * | 4/1988 | Nied | 156/193 |
| 5,793,637 | A * | 8/1998 | Clayton et al. | 700/213 |
| 5,918,359 | A * | 7/1999 | Neuenschwander | 29/564.2 |
| 6,675,452 | B2 * | 1/2004 | Smith | 29/401.1 |
| 6,751,836 | B2 * | 6/2004 | Smith | 29/401.1 |

* cited by examiner

*Primary Examiner*—Jermie E. Cozart
(74) *Attorney, Agent, or Firm*—Steven Thrasher

(57) ABSTRACT

The invention teaches the nesting and spacing of electrowon metal units via an electrowon metal sheet having thereon a spacing feature. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

13 Claims, 2 Drawing Sheets

FIG. 1
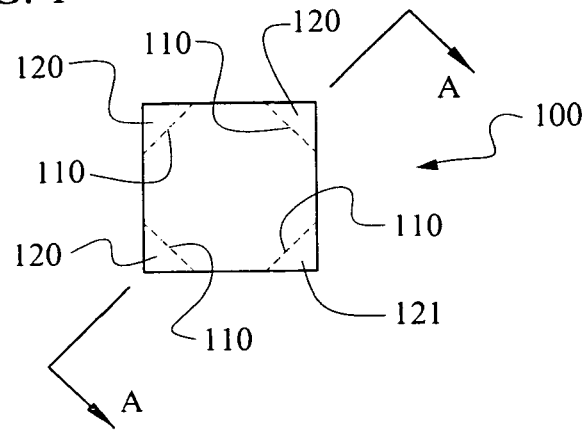
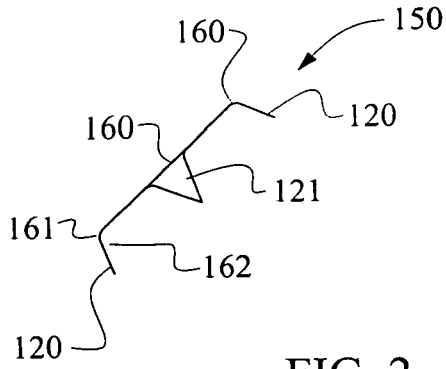
FIG. 2
FIG. 3
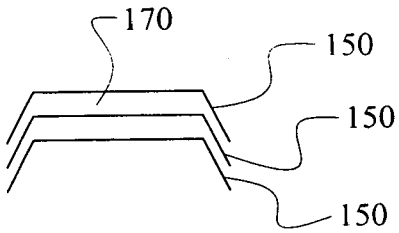
FIG. 4
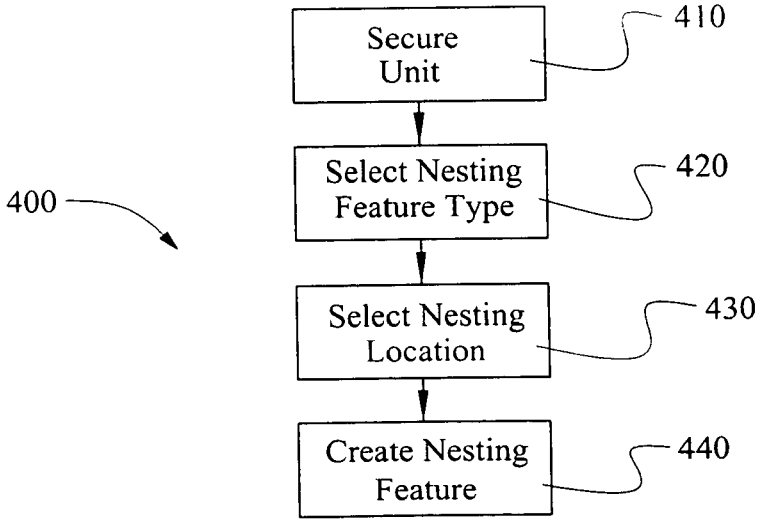

METHOD OF ENABLING THE STACKING OF ELECTROWON METAL UNITS

CROSS TO APPLICATIONS

The invention is a continuation in part of, is related to, and claims priority from U.S. Utility patent application Ser. No. 09/875,528, filed on Jun. 5, 2001, now U.S. Pat. No. 6,751,836 by Richard A. Smith, and entitled Method of Enabling the Spacing of Metal Units.

TECHNICAL FIELD OF THE INVENTION

The invention relates generally to electrowinning, and more particularly to electrowon metal units.

PROBLEM STATEMENT

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

Discussion

Metal units (also called sheets) are commonly used in industrial applications. For example, some copper metal sheets may be used as copper cathodes in mining operations. In addition, zinc metal sheets are used as anodes in industrial water applications to prevent the "pitting" of a metallic container.

Accordingly, the mining industry, the copper cathodes are used in copper bearing solutions of sulfuric acid and water. More specifically, a copper leaching process called SXEW (solvent extraction/electrowinning) is used at most copper mines to extract copper from oxide ores. In practice, this process (called leaching) runs acid and water through a pile or dump of copper bearing oxide ore, and collects the resulting solution for further processing. Accordingly, copper mining and many other industrial processes utilize a large number of metal units.

Sometimes, due to the size limitations, space needed in an industrial application, melting qualities, or other factors, a metallic rod is preferable to a metal unit. Accordingly, sometimes the word "metal unit" is used to describe a metal unit (metal sheet), metal rod, or any other type of stackable metallic processing pieces.

Bundling is the process of gathering and stacking metal units for transport or storage (thus creating a "bundle" of metal units). Although bundling may be interpreted by some to imply the application of a securing device to a bundle, as used herein, bundling means the association of two or more metal units, regardless of purpose. Typically, although not necessarily, the association is a stacking of the metal units.

Unfortunately, many metal units are destroyed or lost in transport between a manufacturing or storing site, and an industrial location that utilizes the metal units. Otherwise apparently static metal units because securing devices, such as metal bands, that are used to support metal units in transport are often insufficiently strong to withstand the forces and momentum generate this. Accordingly, shearing and other forces often cause metal bands to break, or may cause a stack of metal units to fall over. Accordingly, many metal units fall, or slide in a one-on-top-of-each-other fashion, and damage facilities or equipment. Therefore, it would be advantageous to have methods for bundling metal units that more securely maintain the metal units in a stack or other position.

Sometimes, when stacking metal units, the weight of the metal unit itself will cause the center portion of the metal unit to sag. Occasionally, the sagging will be severe enough to cause one metal unit to touch another metal unit. This sagging may result in unpredictable, physical and chemical properties of the reactions involving the metal units are not predictable. For example, unpredictable spacing of metal units makes it difficult to predict heat dissipation, and therefore, the melting properties of the metal units are also unpredictable. In addition, the unpredictable spacing of metal units creates uncertainty in chemical flow between metal units that are undergoing a chemical reaction. Therefore, for these and other reasons it would be advantageous to have methods for spacing metal units in a stack or other position.

BRIEF DESCRIPTION OF THE DRAWINGS

Various aspects of the invention, as well as an embodiment, are better understood by reference to the following detailed description. To better understand the invention, the detailed description should be read in conjunction with the drawings in which:

FIG. 1 is a top down view of a metal unit;

FIG. 2 is a cut-view of the metal unit taken across the diagonal cut line A-A;

FIG. 3 illustrates a plurality of nestable metal units that are nested together;

FIG. 4 illustrates a create nestable metal unit algorithm;

EXEMPLARY EMBODIMENT OF A BEST MODE

Interpretation Considerations

Figure 5:
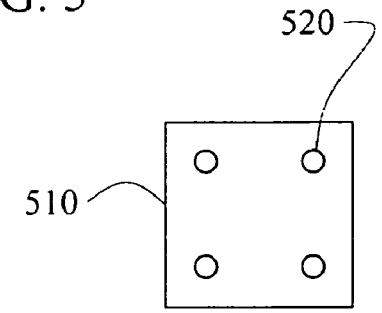
FIG. 5 illustrates a top down view of a metal unit.

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art.

Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for -functioning-" or "step for -functioning-" in the Claims section. Sixth, the invention is also described in view of the Festo decisions, and, in that regard, the claims and the invention incorporate equivalents known, foreseeable, and unforeseeable. Seventh, the language and each word used in the invention should be given the ordinary interpretation of the language and the word, unless indicated otherwise.

Some methods of the invention may be practiced by placing the invention on a computer-readable medium. Computer-readable mediums include passive data storage, such as a random access memory (RAM) as well as semi-permanent data storage such as a compact disk read only memory (CD-ROM). In addition, the invention may be embodied in the RAM of a computer and effectively transform a standard computer into a new specific computing machine.

Data elements are organizations of data. One data element could be a simple electric signal placed on a data cable. One common and more sophisticated data element is called a packet. Other data elements could include packets with additional headers/footers/flags. Data signals comprise data, and are carried across transmission mediums and store and transport various data structures, and, thus, may be used to transport the invention. It should be noted in the following discussion that acts with like names are performed in like manners, unless otherwise stated.

Of course, the foregoing discussions and definitions are provided for clarification purposes and are not limiting. Words and phrases are to be given their ordinary plain meaning unless indicated otherwise.

DESCRIPTION OF THE DRAWINGS

In mining industries, the metal units are generated in bearing solutions via electrolysis. For example, to extract copper from an ore, copper ore is placed in a bearing solution of sulfuric acid and water, and then metal units are placed in the solution so that copper forms on the plates. This is known as a leaching process called "solvent extraction" or "electrowinning," and is used at most copper mines to extract copper from oxide ores. Similar processes are used in other mining industries, such as in the processing of nickel, lead, tin, cadmium, bronze, zinc, silver, gold, and other noble metals, for example. These processes are known to those of skilled in the art in their respective mining industry. The plating of metal to a cathode produces what those in each respective mining industry call an "electrowon metal unit "or" electrowon plate.

A nestable electrowon metal unit is an electrowon metal unit that has features that enable the electrowon metal unit to be securely bundled without the use of a securing device, such as a steel band or a copper coil. Standard electrowon metal units comprise a generally horizontal planar, rectangular metal structure having a thin (typically less than ¼ inch) vertical depth. Here, the horizontal plane has a variable width (also the depth or thickness of the electrowon metal unit) and is generally definable by the surfaces of the electrowon metal unit having the largest surface areas. Thus, a horizontal surface may describe either a top horizontal surface or an opposite bottom horizontal surface of an electrowon metal unit (top and bottom and horizontal thus describe relative positions to make it easier to understand the invention, and are not indicative of an absolute top, absolute bottom or absolute horizontal). Accordingly, the invention teaches configuring electrowon metal units, and methods of modifying electrowon metal units so that the electrowon metal units are at least nestable, and so that they may have controlled spacing. In general, to create a nestable electrowon metal unit, a common nesting location is identified on a first electrowon metal unit (it is "common" in the sense that the other electrowon metal units that are nestable with the first electrowon metal unit will have a similar nesting feature at about the same location.) Furthermore, the electrowon metal units may also include a complementary nesting feature—one that mates with the nesting feature—at a location that mates with the nesting location of the first electrowon metal unit). Then, a force is applied at the nesting location to create a nesting feature.

Accordingly, a nestable electrowon metal unit generally is a metal unit (or metal sheet) having a nesting feature at a common location. Typical electrowon metal units are at least four square feet in area, and preferably at least nine square feet in area. In addition, an electrowon metal unit is generally at least twenty pounds in weight. Of course, the size and weight varies with the type of metal being processed and the time the material is allowed to process. Generally, following the creation of the electrowon metal unit, it is either moved to a second facility for additional processing and purification, or stored for future processing.

When using a nesting feature, electrowon metal units may be stacked (or bundled) by nesting, such that a nestable feature of a first electrowon metal unit snuggly fits into a complimentary nestable feature of a second electrowon metal unit. In practice, nesting electrowon metal units secures the electrowon metal units much more effectively than stacking the electrowon plates the metal units, or even stacking and banding the electrowon metal units (tying the metal units with a metal band). In fact, in some embodiments, the weight and size of an electrowon metal unit becomes an advantage because larger and heavier electrowon metal units have more force pushing them together, and therefore nest more securely.

The invention may be better understood by way of an exemplary illustration. Accordingly, FIG. 1 is a top-down view of an electrowon metal unit 100. Although the electrowon metal unit illustrated in FIG. 1 appears as a plate (or sheet), it should be understood that the principals taught by the invention may be applied to any other shaped metal unit, including rods. In addition, the ore from which the electrowon metal unit is made is generally unimportant. However, for purposes of this present embodiment that is directed at the copper mining industry, the metal unit is preferably a copper cathode. In an alternative embodiment, the electrowon metal unit is nickel, lead, tin, cadmium, bronze, zinc, silver, gold, or another noble metal, for example.

The electrowon metal unit 100 has at least one nesting location, illustrated in FIG. 1 as a plurality of nesting locations 110. In one embodiment, the nesting locations are lines made at each corner of the electrowon metal unit 110, such that the line "cuts" the corner into an approximately isosceles triangle. Accordingly, in the present embodiment, each corner 120 of the metal unit 100 may become a nesting portion of the metal unit, where a nesting portion is the structure that creates a nesting feature at a nesting location. A fourth corner 121 is distinguished from other corners 120 to clarify geometries illustrated in the second figure.

Accordingly, FIG. 2 is a cut-view of the electrowon metal unit 100 taken across the diagonal cut line A-A. In FIG. 2, one may see that the basic shape of the electrowon metal unit 100 remains unchanged. However, at each nesting location 110, a nesting feature (namely a bend 160) has been produced.

Thus, as illustrated in FIG. 3, one alternative nesting feature is a bend. Accordingly, it may be seen that each bend 160 has an outside radius 161, and an inside radius 162 that is different radius (smaller) than the inside radius 162. The disparity in radius size may be used as advantage of the invention, since the inside-outside radius differential creates a natural separation between the electrowon metal units when the electrowon metal units are stacked on top of each other. The space is, in one embodiment, typically about the width of the metal unit itself. Furthermore, the actual separation between the electrowon metal units may be planned by adjusting the angles of the bends. In any event, electrowon metal unit separation enables the metal units to be melted, or otherwise interact with their environment, more quickly than if the electrowon metal units were merely stacked without separation. Among other benefits of the invention, this saves fuel and other energy costs associated with further processing of the electrowon metal units.

It should be understood that many nesting features are possible. For example, one nesting feature may be created by "poking" an electrowon metal unit to create a dimple on one side of the cathode, and a bubble on the other side of the cathode (the dimple and bubble being complementary features). Other nesting features can be created by bending one side, two sides, or all four sides of the electrowon metal unit. Yet additional nesting features could be created by forming a polygonal impression on one side of the electrowon metal unit, and a corresponding raised polygonal structure on the other side of the electrowon metal unit. Similarly, another nesting feature may be built by creating a generally circular impression on one side of a electrowon metal unit, and a corresponding generally circular raised-structure on the second side of the electrowon metal unit. The identification of the nesting feature and its complement should be readily apparent to those of ordinary engineering skill upon reading the present disclosure.

FIG. 4 illustrates a create nestable electrowon metal unit algorithm 400. The create nestable electrowon metal unit algorithm 400 begins with a secure unit act 410. In the secure unit act 410 the electrowon metal unit, irrespective of type or shape, is securely positioned in a cathode nesting press (or, as is understood in the art upon reading the present disclosure, an alternative device). Then, in a select nesting feature type act 420, the algorithm receives an indication of a nesting feature (for example, dimples or bends) to apply to the electrowon metal unit.

This common location is selected in a select nesting location act 430. Preferably, on an electrowon metal unit, the bend is located across each corner, approximately four inches from the corner. Of course, the selection of the nesting location will depend on the type of nesting feature one desires to use.

For example, should one choose to use a dimple nesting feature, it may be more advantageous to select three nesting locations for each metal unit such that the nesting locations form the points of an equilateral triangle, centered about the center of the metal unit. Then, following the select nesting location act 430, the create nestable metal unit algorithm 400 proceeds to create a nesting feature act 440. In the create nesting feature act 440 the cathode nesting press is activated and an appropriate nesting feature is created. In one embodiment, the cathode nesting press bends the electrowon metal unit in the nesting location in the create nesting feature act 440. Alternatively, if a dimple is selected as the nesting feature the cathode nesting press will create the dimple(s) at the desired nesting location(s) in the create nesting feature act 440.

Sometimes, it is advantageous to provide spacing features to provide more predictable and controlled spacing between stacked electrowon metal units. FIG. 5 illustrates a top down view of an electrowon metal unit 510 having spacing features 520 thereon. A spacing feature 520 should be placed at a location on the electrowon metal unit 510 that provides a logical structural weight support for the weight of the electrowon metal unit 510. In one embodiment, for the electrowon metal unit 510, the spacing feature locations are co-located with the spacing features 520. Thus, the spacing features are located at spacing feature locations, and the spacing feature locations are spaced approximately at the corners of a square, and the square is approximately centered about mid-point of the metal unit. Of course, alternative placements of the spacing features are logical and are apparent to those of ordinary skill in the art upon reading the disclosure.

For example, spacing features may be placed at spacing feature locations spaced approximately at the corners of an equilateral triangle, where the equilateral triangle is approximately centered about the mid-point of the metal unit. The size of the equilateral triangle, square, or other shape is selected as needed to provide adequate support. Of course, it is not necessary to have shape-selected spacing, and it should be understood that the random (or, apparently random) spacing of spacing features is within the scope of the invention.

Figure 6:
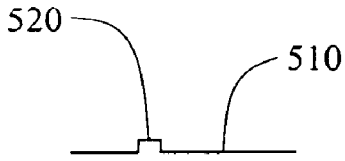
FIG. 6 illustrates the metal unit.
Figure 7:
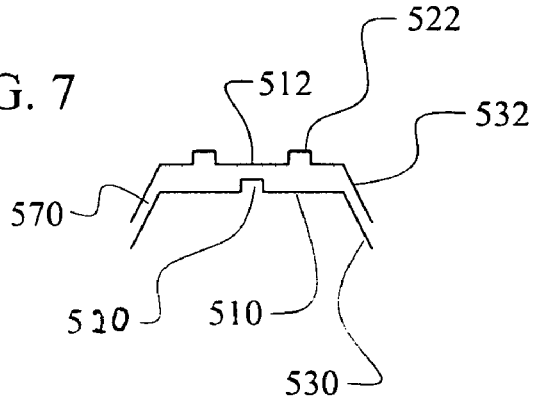
FIG. 7 generally illustrates the stacking of a first metal unit.

The type of spacing feature chosen may depend upon factors such as size of the actual spacing desired, the weight of the metal plate(s) that must be supported, or a host of other factors that are well known in the art. FIG. 6 illustrates the electrowon metal plate 510 having the spacing feature 520 as a dimple. However, it should be understood that bubbles, ribs, polygonal impressions, circular impressions, or other types of indentions may be used to create spacing features. The spacing feature may be a figure having at least three sides. The spacing feature may also be an oval impression. FIG. 7 generally illustrates the stacking of a first electrowon metal unit 510 and a second electrowon metal unit 512. The first electrowon metal unit 510 has a first bend 530 which is used as a nesting feature, and, likewise, the second electrowon metal unit 512 has a second bend 532, which acts as a nesting feature for the second electrowon metal unit 520.

The first electrowon metal unit 510 has a spacing feature 512, embodied as a dimple. Likewise, the second electrowon metal unit 512 has a plurality of spacing features 522, embodied as dimples. When stacked one on top of the other, the result of the stacking configuration illustrated in FIG. 7 is the preservation of a predictable spacing 570. It should be understood that the spacing features and nesting features and spacing illustrated in FIG. 7 are not drawn to scale.

From FIG. 7 it should be understood that it is not necessary to apply the same spacing feature to every electrowon metal unit in a stack of electrowon metal units. In addition, one should understand from FIG. 7 that it is not necessary to align the spacing features when stacking electrowon metal units. However, it should also be understood that aligning spacing features and nesting features is an embodiment of a method of the invention. Also, other configurations for stacking electrowon metal units and for the organization of spacing features when stacking electrowon metal units are readily apparent upon reading the present disclosure, and have many alternatives which will be readily apparent to those of ordinary skill in the art.

Figure 8:
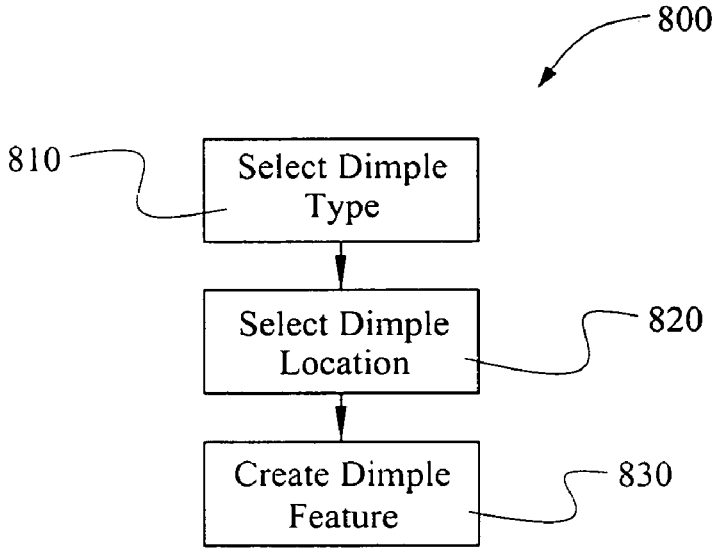
FIG. 8 illustrates a spacing algorithm.

The creation of a spacing feature may be achieved by a spacing algorithm. FIG. 8 illustrates a spacing algorithm 800. The spacing algorithm 800 begins with a select spacing feature type act 810. Accordingly, in the selected spacing feature act 810, a spacing feature, such as a dimple, a bubble, a rib, a polygonal impression, a circular impression, or other impression, may be selected by either a user, or a defined algorithm, as a spacing feature type. Then, in a select spacing feature location act 820 a spacing feature location is chosen, again either by a user or a predefined algorithm. In an embodiment, the spacing feature location act 820 selects spacing features at approximately the corners of a square that is approximately centered about the mid point of an electrowon metal unit. Preferably, the spacing feature type is a dimple.

Next, the spacing algorithm 800 proceeds to a create spacing feature act 830. In the create spacing feature act 830 the appropriate spacing feature is created in the electrowon metal unit. This is typically achieved with a spacing feature press. Thus, if a dimple spacing feature is desired, the spacing feature press will impact (or impress) the electrowon metal unit in the spacing feature location to create the spacing feature, such as a dimple.

Of course, it should be understood that the order of the acts of the algorithms discussed herein may be accomplished in different order depending on the preferences of those skilled in the art, and such acts may be accomplished as software. Furthermore, though the invention has been described with respect to a specific preferred embodiment, many variations and modifications will become apparent to those skilled in the art upon reading the present application. It is therefore the intention that the appended claims and their equivalents be interpreted as broadly as possible in view of the prior art to include all such variations and modifications.

I claim:

1. A method of modifying an electrowon metal unit to enable the stacking of a plurality of electrowon metal units, comprising:

receiving an identification of a nesting feature location on an electrowon metal unit, and directing the application of a force at the nesting feature location to create a nesting feature.

2. The method of claim 1 further comprising directing the securing of the electrowon metal unit.

3. The method of claim 1 further comprising receiving a selection of a nesting feature type.

4. The method of claim 3 wherein the nesting feature comprises a bend.

5. The method of claim 3 wherein the nesting feature comprises at least three dimples spaced approximately at the corners of an equilateral triangle, the equilateral triangle approximately centered about the midpoint of the electrowon metal unit.

6. The method of claim 3 wherein the nesting feature comprises at least four dimples spaced approximately at the corners of a square, the square approximately centered about the midpoint of the electrowon metal unit.

7. The method of claim 3 further comprising forming a spacing feature on the electrowon metal unit wherein the spacing feature comprises a figure having at least three sides.

8. The method of claim 3 further comprising forming a spacing feature on the electrowon metal unit wherein the spacing feature comprises a generally polygonal impression.

9. The method of claim 3 further comprising forming a spacing feature on the electrowon metal unit wherein the spacing feature comprises a generally oval impression.

10. The method of claim 1 wherein the electrowon metal unit is a copper cathode.

11. The method of claim 1 wherein the electrowon metal unit comprises a surface area of at least four square feet.

12. The method of claim 1 further comprising forming a spacing feature on the electrowon metal unit wherein the spacing feature is created upon a horizontal plane of the electrowon metal unit.

13. The method of claim 1 further comprising creating the nesting feature by altering a horizontal plane of the electrowon metal unit.

* * * * *